US009108089B1

(12) United States Patent
Termini

(10) Patent No.: US 9,108,089 B1
(45) Date of Patent: Aug. 18, 2015

(54) GOLF CLUB INCLUDING IMPROVED CLUB HEAD, IMPROVED CLUB HEAD FOR SAME, AND GOLF TRAINING AID

(71) Applicant: James A. Termini, Dickinson, TX (US)

(72) Inventor: James A. Termini, Dickinson, TX (US)

( * ) Notice: Subject to any disclaimer, the term of this patent is extended or adjusted under 35 U.S.C. 154(b) by 63 days.

(21) Appl. No.: 13/871,192

(22) Filed: Apr. 26, 2013

(51) Int. Cl.
*A63B 69/36* (2006.01)
*A63B 53/04* (2015.01)

(52) U.S. Cl.
CPC ..... *A63B 53/04* (2013.01); *A63B 69/36* (2013.01)

(58) Field of Classification Search
CPC ..... A63B 53/04; A63B 69/36
USPC ..... 473/251–254, 236, 242, 330, 325, 340, 473/341, 313, 324; 273/129 R; D21/736–746
See application file for complete search history.

(56) References Cited

U.S. PATENT DOCUMENTS

| | | | | | |
|---|---|---|---|---|---|
| 1,674,173 | A * | 6/1928 | Haupt | 473/330 |
| D137,064 | S * | 1/1944 | Roberts | D21/726 |
| 2,577,189 | A * | 12/1951 | Hammett | 273/129 R |
| 2,693,960 | A * | 11/1954 | Bour | 273/127 B |
| 3,881,733 | A * | 5/1975 | Csernits | 473/330 |
| 4,290,606 | A * | 9/1981 | Maxwell | 473/569 |
| 4,383,690 | A * | 5/1983 | Maxwell | 473/252 |
| 4,846,477 | A * | 7/1989 | Phelan | 473/330 |
| 6,605,008 | B1 * | 8/2003 | Kovarik | 473/329 |
| 7,264,557 | B1 * | 9/2007 | Grossbard | 473/325 |
| 8,597,136 | B1 * | 12/2013 | Grossbard | 473/325 |
| 2002/0151374 | A1 * | 10/2002 | Imamura | 473/236 |
| 2006/0094532 | A1 * | 5/2006 | Seeley | 473/330 |
| 2006/0211513 | A1 * | 9/2006 | Uglietto | 473/324 |
| 2009/0305806 | A1 * | 12/2009 | Campadore et al. | 473/236 |

* cited by examiner

*Primary Examiner* — Sebastiano Passaniti
(74) *Attorney, Agent, or Firm* — Buche & Associates, P.C.; John K. Buche; Scott Compton

(57) ABSTRACT

Embodiments provide a golf club for striking a golf ball, the golf club including an elongated shaft, the shaft having an upper end portion spaced apart from a lower end portion, a club head disposed at the lower end portion, the club head having a first club-face portion for striking the golf ball, the club head having a second club-face portion for striking the golf ball, relative to the first club-face portion the second club-face portion defining there between a ninety degree angle.

27 Claims, 9 Drawing Sheets

TABLE OF EXEMPLARY FIRST AND SECOND TILT ANGLES 147, 147'
AND CENTRAL LOFT ANGLES 146

| First tilt angle 147 or second tilt angle 147' | Central loft angle 146 | Nominal Club Loft = (first tilt angle 147 + second tilt angle 147') | Central Loft Angle 146 as a percentage of Nominal Club Loft |
|---|---|---|---|
| 1 | 1.4141 | 2 | 70.70 |
| 5 | 7.0532 | 10 | 70.53 |
| 10 | 14.0019 | 20 | 70.01 |
| 15 | 20.7536 | 30 | 69.18 |
| 20 | 27.2363 | 40 | 68.09 |
| 30 | 39.2315 | 60 | 65.39 |

FIG. 20

GOLF CLUB INCLUDING IMPROVED CLUB HEAD, IMPROVED CLUB HEAD FOR SAME, AND GOLF TRAINING AID

FIELD OF INVENTION

The disclosure relates to golf clubs, club head components, and golf training aids.

BACKGROUND OF INVENTION

A player striking a golf ball with a golf club sends the ball flying, bouncing or rolling away across the ground. Trajectory and path of the golf ball when struck depends, in part, on the club selected and execution of a golf swing by the player. Golfers use different clubs to execute different shots. Any of several driving clubs ("woods" or "metal woods") having slight loft are used to send the ball on a relatively long, low flight trajectory. Any of several iron clubs having a wide range of lofts are used to send the ball on relatively shorter, higher flight trajectories. A putter having no loft, or almost no loft, is used for shots ("putts") where the ball is sent rolling across the ground (i.e., the "green") towards a cup in the ground.

For reasons stated below, and for other reasons which will become apparent to those skilled in the art upon reading the present specification, there is a need in the art for golf clubs including an improved club head, improved club head components for golf clubs, and improved golf training aids.

BRIEF DESCRIPTION OF INVENTION

Embodiments provide a golf club having an improved club head, improved club head components for golf clubs, and improved golf training aids. Various shortcomings, disadvantages and problems of golf clubs, club head components and training aids are addressed herein, which will be understood by reading and studying the following specification.

BRIEF DESCRIPTION OF DRAWINGS

FIG. 20 is a table of exemplary values of first and second tilt angle, central tilt angle, and central loft.

DETAILED DESCRIPTION OF EMBODIMENTS

Figure 1:
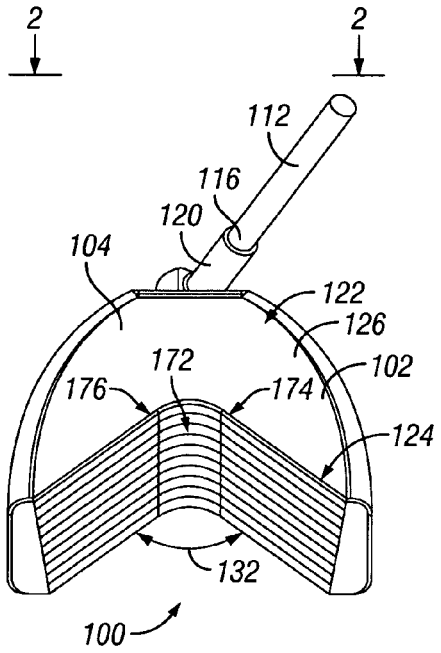
FIG. 1 is a partial elevated front perspective view of a golf club according to an embodiment.

In the following detailed description of embodiments, reference is made to the accompanying drawings that form a part hereof, and in which is shown by way of illustration specific embodiments which can be practiced. Embodiments are described in sufficient detail to enable those skilled in the art to practice the embodiments, and it will be understood by one of ordinary skill that other embodiments can be utilized and that logical, mechanical and other changes can be made without departing from the scope of the embodiments. The following detailed description is, therefore, not to be taken in a limiting sense and shall not limit the scope of the claims.

FIGS. 1 through 8 and 19 and 21 show a golf club 100 according to an embodiment. Golf club 100 is configured to be swung by a golfer performing a golf swing to hit a golf ball, where the golf ball initially rests in a stationary position on the ground. One of ordinary skill will understand that golf club 100 has a compound club face and for this reason possibly does not conform to the present rules of golf promulgated by the various rule-making bodies governing the sport around the world. One of ordinary skill will understand that an item similar to a golf club, but possibly not conforming to the promulgated rules of golf, may be referenced in the alternative as a non-conforming golf club. One of ordinary skill will understand that the golf club 100 can be used to train golfers on a practice range or elsewhere and, from this view, can be properly referenced as a golf training aid. As used herein "golf club" includes, in addition to golf clubs conforming to the promulgated rules of golf, both non-conforming golf clubs and golf training aids. One of ordinary skill thus will understand that Claims following herein directed to a "golf club" are directed to golf clubs conforming to the promulgated rules of golf, non-conforming golf clubs and golf training aids, without limitation. One of ordinary skill thus will understand also that Claims following herein directed to a "club head" are directed to club heads for golf clubs conforming to the promulgated rules of golf, non-conforming golf clubs and golf training aids, without limitation. One skilled in the art will appreciate that golf club 100 can be configured differently without departing from the scope of the present disclosure and embodiments. One of ordinary skill will understand, for example, that golf club 100 is configured with a club head 102 which is a driving wood club head 104, and that club head 102 can be configured differently as, for example, an iron club head 204 (shown in FIG. 9), a putter club head 304 (shown in FIG. 14), or a hybrid driving wood-iron ("hybrid") club head (not shown). Returning to FIG. 1, one skilled in the art will understand that golf club 100 illustrated in FIG. 1 is a specific embodiment of subject matter more broadly disclosed herein, and is described in this written description and illustrated in the drawings in order to satisfy statutory requirements, and is not to be interpreted as limiting the scope of any claim.

Figure 7:
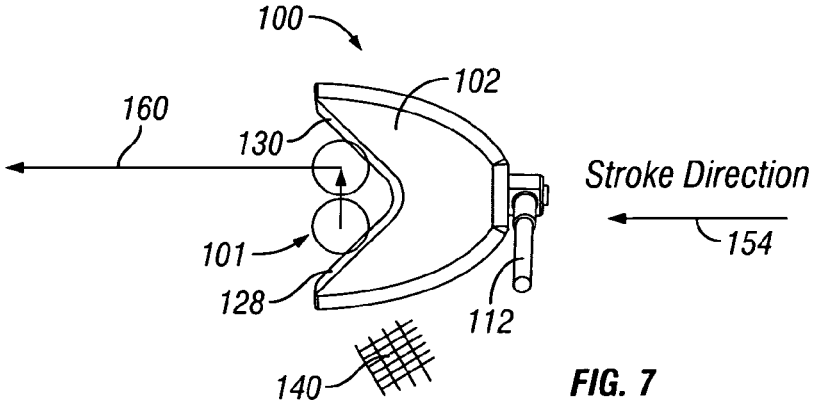
FIG. 7 is a schematic view showing a golf club according to an embodiment striking a golf ball to send the ball for travel along a ball path.

FIG. 1 is a partial elevated front perspective view of golf club 100 according to an embodiment. Golf club 100 is configured for striking a golf ball 101 (golf ball 101 not being shown in FIG. 1; golf ball 101 being shown in FIG. 7 and FIG. 8). Referring to FIG. 7, it will be understood that golf club 100 is configured to be swung by a player 103 gripping a golf grip on the club shaft and performing a golf stroke (not shown) to strike the golf ball 101 residing in a stationary position on the ground. The golf swing and golf clubs are the subject of numerous texts. One text describing the golf swing, and the use of golf clubs by players to execute the golf swing, is *How to Become a Complete Golfer*, by Bob Toski (Random House 1987). The entire content of the aforementioned text, *How to Become a Complete Golfer*, is incorporated herein by this reference to the same. Referring to FIG. 7, the club head 102 travels along a club head line of travel 154 in the direction of the golf stroke (i.e., stroke direction) and sends the golf ball 101 traveling along a ball path 160 towards a target (not shown).

Returning to FIG. 1, golf club 100 includes an elongated shaft 112. Shaft 112 has an upper end portion (not shown) spaced apart from a lower end portion 116. One of ordinary skill will understand that any suitable, commercially available golf club shaft 112 can be used. Suitable golf club shafts 112 are available from, for example, True Temper Sports (Memphis, Tenn.). Golf club 100 can include a golf club grip (not shown) affixed to the upper end portion and suitable for a player (not shown) to grip the shaft 112 for swinging the golf club 100 to perform a golf stroke.

Returning to FIG. 1, golf club 100 includes club head 102 disposed at the lower end portion 116 and affixed to shaft 112 in fixed relationship therewith. Club head 102 is affixed to lower end portion 116 by a suitable fastener (not shown). One of ordinary skill will understand that club head 102 typically is affixed to lower end portion 116 by a suitable fastener that is a suitable cured adhesive fastener (not shown). In the specific embodiment shown in FIG. 1, club head 102 includes a hosel 120 housing the lower end portion 116 with suitable cured adhesive fastener (not shown) there between and securing lower end portion 116 therein.

It will be understood that, in the embodiment shown in FIG. 1, the club head 102 is a driving wood club head 104 having a large, rounded rear portion 122 for sending the golf ball (not shown in FIG. 1) on a relatively long, low flight trajectory. In the specific embodiment illustrated in FIG. 1, hosel 120 is supported by rear portion 122 in fixed rigid relationship therewith. Club head 102 has a forward portion 124 forward of the rear portion 122 and joined therewith in fixed, rigid relationship. In the specific embodiment shown in FIG. 1, forward portion 124 and rear portion 122 are formed together in integral relationship of a common club head material 126. One of ordinary skill will appreciate that club head 102 can be formed of club head material 126 in any suitable manner. In the specific embodiment illustrated, club head 102 is formed of club head material 126 cast into the specific form of the driving wood club head 104. One of ordinary skill will understand that any suitable casting techniques can be used, as are well-know for the production of club heads. In other embodiments (not shown) club head material 126 can be shaped to provide club head 102 in another suitable manner such as, for example, by machining a unitary piece of club head material 126 to provide the shape of driving wood club head 104.

Figure 2:
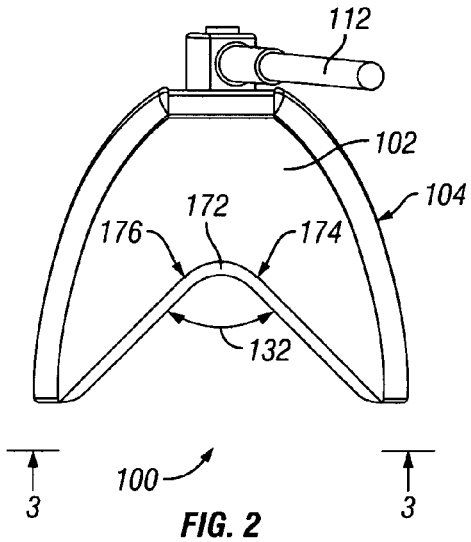
FIG. 2 is an partial top plan view of the golf club shown in FIG. 1 and taken generally along 2-2.

FIG. 2 is a partial top plan view of the golf club shown in FIG. 1 and taken generally along 2-2. Forward portion 124 of club head 102 includes a first club-face portion 128 for striking the golf ball 101 (shown in FIG. 7). Club head 102 includes a second club-face portion 130 for striking the golf ball 101 (not shown). The second club-face portion 130 relative to the first club-face portion 128 defines there between a dual club face angle 132. The dual club face angle 132 is ninety degrees (90°).

Club head 102 can have any suitable loft. In the specific embodiment shown in FIG. 2, club head 102 is a driving wood club head 104 having suitable loft for sending the golf ball (not shown) on a relatively long, low flight trajectory. One of ordinary skill will understand that, although driving wood club head 104 can have different loft, the loft of a driving wood club head 104 generally is in the range of about seven (7) degrees to about thirty-one (31) degrees.

Figure 3:
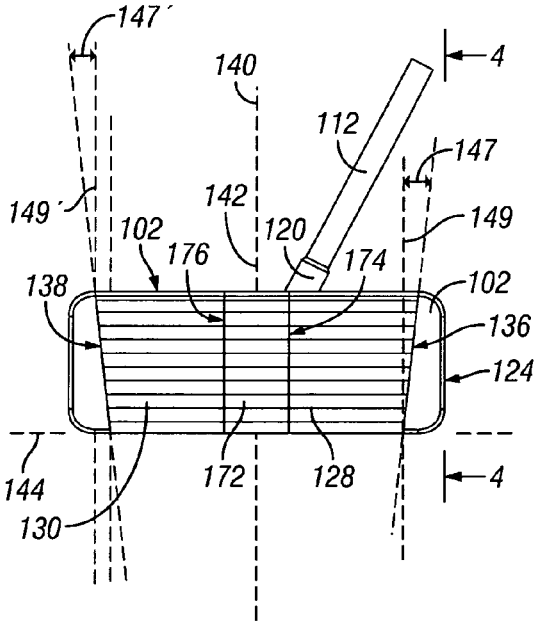
FIG. 3 is a partial front elevation view of the club shown in FIG. 2 and taken generally along 3-3.
Figure 4:
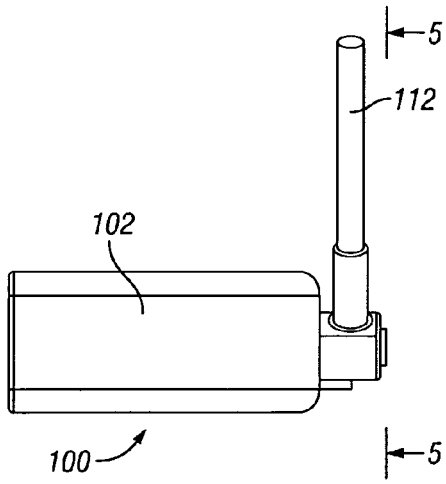
FIG. 4 is a partial side elevation view of the club shown in FIG. 3 and taken generally along 4-4.
Figure 6:
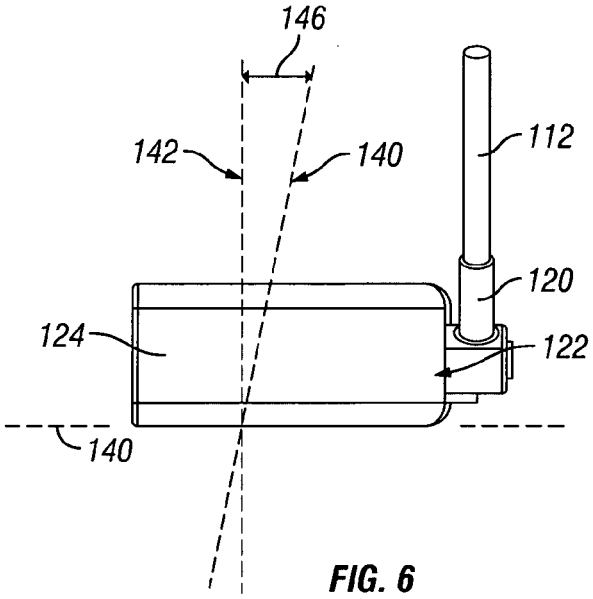
FIG. 6 is a partial side elevation view of the club shown in FIG. 3 and taken along 6-6 with aspects indicated in phantom lines.
Figure 19:
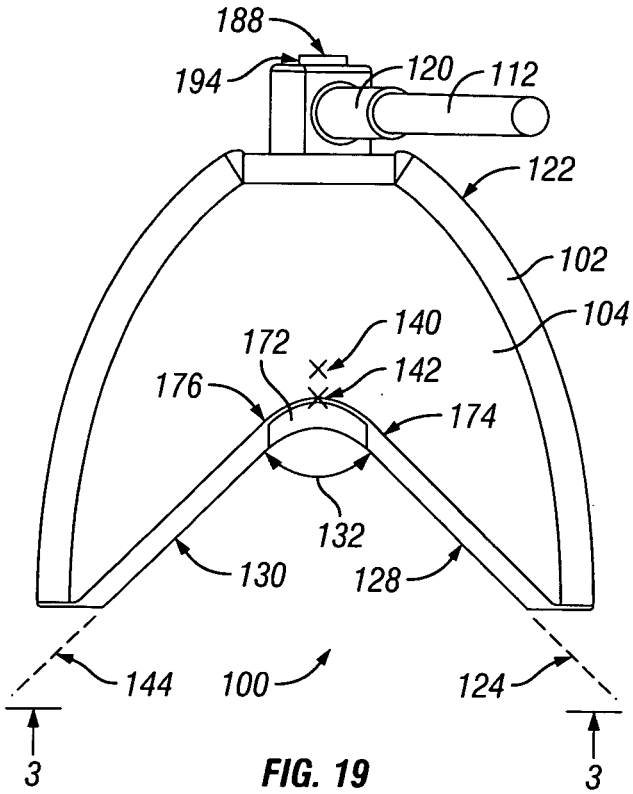
FIG. 19 is an enlarged partial top plan view identical to FIG. 2.

FIG. 3 is a partial front elevation view of the club shown in FIG. 2 and taken generally along 3-3. First club face portion 128 defines a first club-face plane 136 coextensive therewith. Second club-face portion 130 defines a second club-face plane 138 coextensive therewith. First club-face plane 136 intersects the second club-face plane 138 along a central loft reference axis 140. Along the central loft reference axis 140, the first club-face plane 136 is disposed at a ninety degree angle, which is the dual club face angle 132 (shown in FIG. 2) intermediate and relative to the second club-face plane 138. Referring to FIG. 3, a zero-loft reference axis 142 is disposed at a ninety degree)(90° angle relative to a horizontal reference plane 144. It will be understood by those of ordinary skill that horizontal reference plane 144 can be identified at any suitable vertical position relative to the first club-face plane 136 and second club-face plane 138. Referring to FIG. 3, in the specific embodiment illustrated, the horizontal reference plane 144 extends through the bottom edges of first club face portion 128 and second club face portion 130. One of ordinary skill will understand that zero-loft reference axis 142 extends in perpendicular relation to horizontal reference plane 144, thus forming a ninety degree (90°) angle relative thereto. Referring to FIG. 19, central loft reference axis 142 is defined at an intersection of first club face plane 136 and second club face plane 138 at a vertical position above and spaced apart from the horizontal reference plane 144. In the specific embodiment shown in FIG. 19, the central loft reference axis 142 is defined at an intersection of first club face plane 136 and second club face plane 138 at an extension in the horizontal direction along the upper edges of the first club face plane 136 and second club face plane 138. As shown in FIG. 6, central loft angle 146 is defined between central loft reference axis 140 and zero-loft reference axis 142. First tilt angle 147 is defined between the first club face plane 136 and a vertically extending first tilt reference plane 149. Second tilt angle 147' is defined between second club face plane 138 and a respective vertically extending second tilt reference plane 149'. Loft is imparted to the ball first by first club face portion 128 and then by second first club face portion 130, such that nominal loft of golf club 100 is the sum of first tilt angle 147 and second tilt angle 147'. The nominal club head loft is equal to the sum of the loft of the first club face portion 128 inclined at first tilt angle 147 and the loft of the second club face portion 130 inclined at second tilt angle 147'. The nominal club head loft determines the nominal ball flight launch trajectory resulting from using club 100. One of ordinary skill will understand that vertical ball flight trajectory followed by golf ball 101 results from nominal ball flight launch trajectory. This disclosure does not expressly consider factors including ball spin, dimpling, center of gravity of the golf ball, wind or manipulation of the golf club 100 or swing path to create an effective loft different from the nominal club head loft 148. Shown in the leftmost column of the table in FIG. 20 are exemplary values of first and second tilt angles 147, 147'. One of ordinary skill in the art will understand that values different from those set forth in FIG. 19 can be used. One of ordinary skill will understand that exemplary values of the central loft angle 146 of the transition club face portion 172 are shown in the rightmost column of the table in FIG. 20. In the specific embodiment illustrated in FIG. 3, the central loft angle 146 is related to the first and second tilt angles 147, 147' according to the equation: (central loft angle 146)=$\tan^{-1}$[(√2)×tan(first or second tilt angle 147, 147')]. One of ordinary skill will understand that the first and second tilt angles 147, 147' and central loft angle 146 can be of different suitable values not shown in FIG. 20.

FIG. 7 is a schematic view showing a golf club according to an embodiment striking a golf ball for travel along a ball path. One of ordinary skill will understand that loft and vertical component of the ball path are not shown in FIG. 7. One of ordinary skill will understand, particularly, that golf ball 101 is struck by both first club face portion 128 and then second club face portion 130. The sequence of the first club face portion 128 and second club face portion 130 striking golf ball 101 is determined by the club head line of travel 154 of club head 102 relative to stationary golf ball 101. One of ordinary skill will understand that stationary golf ball 101 when struck by one of the first club face portion 128 and second club face portion 130 is deflected at an angle, particularly identified as the initial deflection angle, so as to be struck by the other of the first club face portion 128 and second club face portion 130. When struck by the other of the first club face portion 128 and second club face portion 130, the golf ball 101 is deflected at an angle, particularly the secondary deflection angle, so as to be directed along a ball path of travel 160 that is collinear or parallel with the stroke direction 154. According to embodiments, the secondary deflection angle is a reflection of the primary deflection angle, such that the golf ball is directed along a ball path of travel 160 that is collinear or parallel with stroke direction 154. One of ordinary skill will understand that the ball path of travel 160 has a component in the horizontal dimension relative to a horizontal reference plane 140, such as for example, at ground level immediately beneath ball 101. One of ordinary skill will understand that, in this disclosure, ball path of travel 162 in a horizontal dimension relative to horizontal ground reference plane 140 is distinct from vertical ball flight trajectory that results from club head loft in a vertical dimension. One of ordinary skill will understand that, if the golf ball 101 is not struck initially by one of the first club face portion 128 and second club face portion 130, but is struck initially by another portion of club head 102, then the golf ball 101 may not be deflected at an angle so as to be struck by the other of the first club face portion 128 and second club face portion 130.

Figure 8:
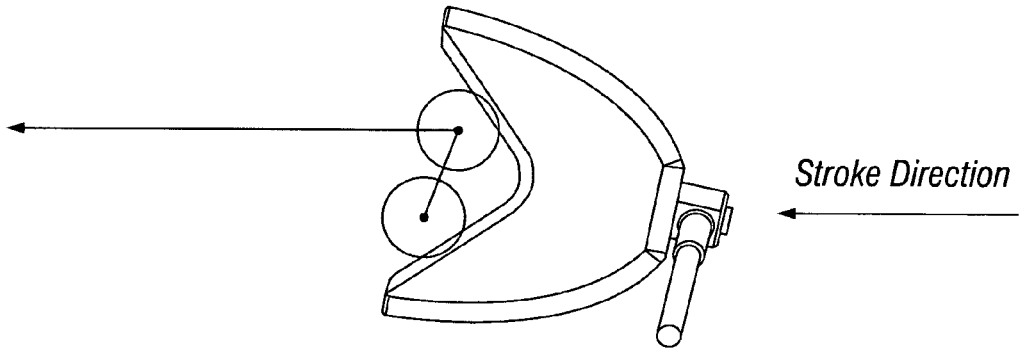
FIG. 8 is a schematic view similar to FIG. 7, showing a golf club aligned with the club head facing a twist direction with a twist angle defined between the twist direction and stroke direction.

FIG. 8 is a schematic view similar to FIG. 7, showing a golf club aligned with the club head facing a twist direction with a twist angle defined between the twist direction and stroke direction. Referring to FIG. 8, one of ordinary skill will understand that each of the first club face portion 128 and second club face portion 130 during the golf stroke can face along a twist direction 154' that differs from the stroke direction 154. A twist angle 155 is defined between stroke direction 154 and twist direction 154'. One of ordinary skill will understand that even though the first club face portion 128 and second club face portion 130 during the golf stroke can face along a twist direction 154' that differs from the stroke direction 154, the golf ball 101 upon being struck by first club face portion 128 and second club face portion 130 is directed in the horizontal direction along the same ball path of travel 160 that is collinear with and parallel to the stroke direction 154. The ball path of travel 160 thus is determined by the stroke direction 154 and is independent of twist angle 155. One of ordinary skill will understand that embodiments provide a golf club 100 for directing golf ball 101 along a ball path of travel 160 collinear or parallel with stroke direction 154 independent of twist angle 155. That the ball path of travel 160 imparted to golf ball 101 is collinear or parallel to the stroke direction 154 in the horizontal plane is an advantage of golf club 100 and embodiments disclosed herein.

Referring to FIG. 6, one of ordinary skill will understand that the nominal club loft for a particular club 100 is equal to the central loft angle 146. It is noted also, that in some embodiments (not shown), the first club-face portion 128 has a loft angle equal to the second club-face portion 130, so that the nominal club loft is the sum of both the first club-face portion 128 and second club-face portion 130. Returning to FIG. 3, it will be understood that in the specific embodiment illustrated where club head 102 is driving wood club head 104, the central loft angle 146 is in the range from about 7 degrees to about 31 degrees.

Referring again to FIG. 1 and FIG. 3, in the specific embodiment illustrated, club head 102 includes a transition club-face portion 172. Transition club-face portion 172 is located intermediate first club-face portion 128 and second club-face portion 130. Transition club-face portion 172 extends from the first club-face portion 128 to the second club-face portion 130. In the specific embodiment shown in FIG. 1 and FIG. 3, transition club-face portion 172 is joined in fixed integral relationship with the first club-face portion 128 and second club-face portion 130. The transition club-face portion 172 has a curved profile from a first transition 174 with the first club-face portion 128 to a second transition 176 with the second club-face portion 130. It will be understood that the curved profile of transition club-face portion 172 from the first club-face portion 128 to a second transition 176 is characterized by a respective curvature having a radius expressed relative to a center. It will be understood that the radius of curving transition club-face portion 172 can be any value suitable for golf ball 101 to be struck by transition club-face portion 172. In the specific embodiment shown in FIG. 1, the radius of transition club-face portion 172 is equal to the outside radius of golf ball 101. The radius of transition club-face portion 172 when equal to the outside radius of a standard U.S. golf ball 101 is about 1.68 inches to receive the same. Along the curved profile from the first transition 174 to the second transition 176, the transition club-face portion 172 has a constant transition loft angle equal to the central loft angle 146. One of ordinary skill will understand that, according to embodiments (not shown), transition club-face portion 172 can have a plurality of transition loft angles (not shown) that change at different locations from the first transition 174 to the second transition 176. One of ordinary skill will understand that, according to embodiments (not shown), transition club-face portion 172 is omitted, such that first club-face portion 128 abuts, or is directly joined together in fixed integral relationship with, second club-face portion 130. One of ordinary skill will understand that, according to embodiments (not shown), transition club-face portion 172 is present but of minor dimensions and is positioned so as to not strike a golf ball 101, such that golf ball 101 is struck only by first club-face portion 128 and second club-face portion 130. Where transition club-face portion 172 is present but of minor dimensions and is positioned so as to not strike a golf ball 101, transition club face portion 172 can have a substantially straight, rather than curved, profile. One example of a transition club-face portion 172 that is present but of minor dimensions, and which is positioned so as to not strike a golf ball 101, is a transitional club-face portion 172 that extends only a very short distance from the first club-face portion 128 to second club-face portion 130, such as deep in a corner area formed by close proximity between the first club-face portion 128 and second club-face portion 130.

Figure 5:
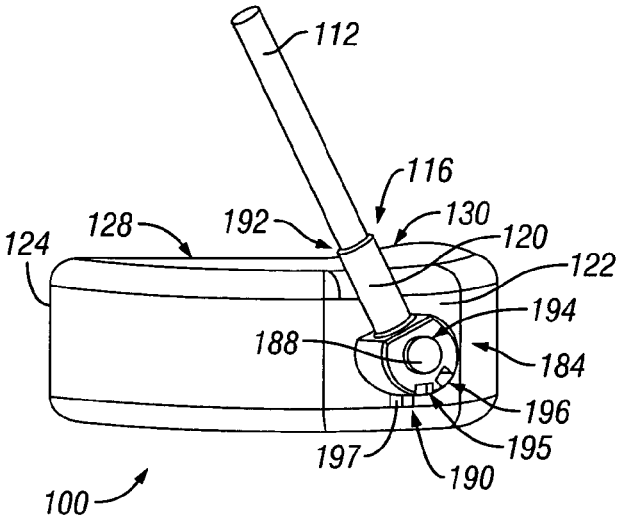
FIG. 5 is a partial elevated rear perspective view of the golf club shown in FIG. 4 and taken generally along 5-5.

Referring to FIG. 5, embodiments provide a golf club 100 including a shaft 112 having a lower end portion 116, a club head 102, and an angularly selectable connecting mechanism 184 configured to enable a player to selectively position the shaft 112 relative to club head 102 for either right-handed play or left-handed play. In the specific embodiment illustrated in FIG. 5, angularly selectable connecting mechanism 184 includes hosel 120 supported by carrier shaft 188, and interlocking hosel position selector 190. Hosel 120 has a tubular receiving aperture 192 configured to receive lower end portion 116 of shaft 112 in rigid, fixed relationship therewith. In the specific embodiment illustrated in FIG. 5, suitable permanent cured adhesive fastening material (not shown) is disposed with shaft 112 in tubular receiving aperture 192 of hosel 120 to join the same in fixed, rigid relationship. Hosel 120 includes a carrier shaft receiving aperture 194 configured to capture the carrier shaft 188. Hosel 120 at carrier shaft receiving aperture 194 is selectively positionable relative to carrier shaft 188 in one of two angular orientations relative to club head 102. Hosel 120 contains a right-hand keyway 195 and left-hand keyway 196 spaced at different angular positions around the perimeter of carrier shaft receiving aperture 194. Club head 102 includes a spring-loaded projecting key 197 adjacent the carrier shaft 188. Key 197 is dimensioned to be received in either right-hand keyway 195 or left-hand keyway 196 upon selection by the player of either a right-handed or let-handed swing position. It will be understood that the right-hand keyway 195 and left-hand keyway 196 are positioned at different angular orientations, such that hosel 120, having shaft 112 joined therewith, is selectively positionable relative to carrier shaft 188 for a right-handed golf swing or left-handed golf swing upon selecting respective of right-hand keyway 195 and left-hand keyway 196. It will be understood that the other of the right-hand keyway 195 and left-hand keyway 196 can be selected by manually depressing the spring-loaded key 197 to permit the hosel 120 to be turned relative to carrier shaft 188. The club head 102 with the right-handed keyway 195 engaged by the spring-loaded projecting key 197 places the shaft 112 in a right-handed swing configuration (shown in FIG. 5) enabling a right-handed person to perform a corresponding right-handed golf swing. The club head 102 with the left-hand keyway 196 engaged by the spring-loaded projecting key 197 places the shaft 112 in a left-handed swing configuration (not shown) enabling a left-handed person to perform a corresponding left-handed golf swing.

Figure 9:
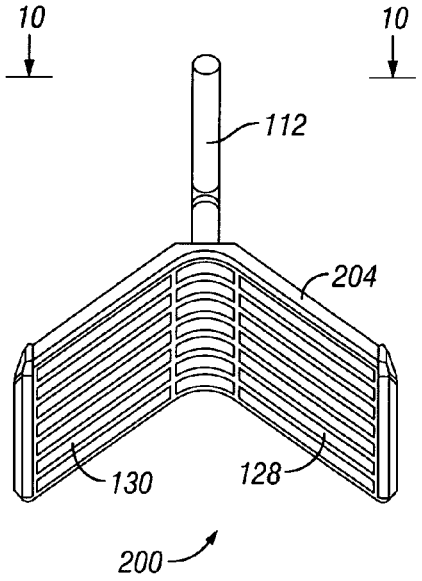
FIG. 9 is a partial elevated front perspective view of a golf club according to an embodiment.
Figure 10:
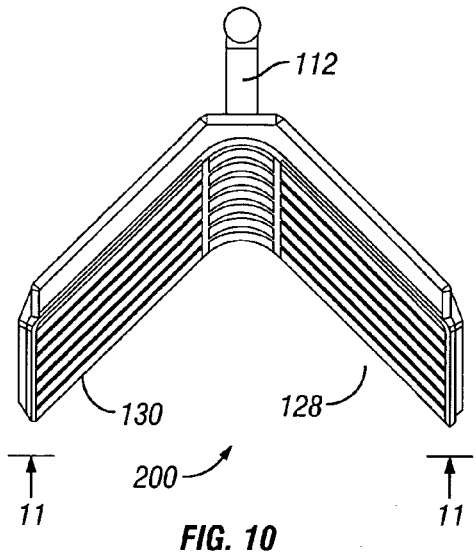
FIG. 10 is a partial top plan view of the golf club shown in FIG. 9 and taken generally along 9-9.
Figure 11:
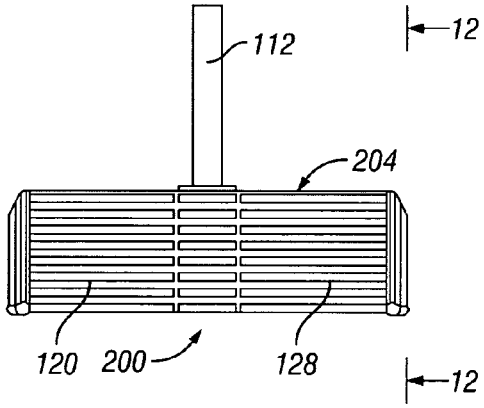
FIG. 11 is a partial front elevation view of the club shown in FIG. 10 and taken generally along 10-10.
Figure 12:
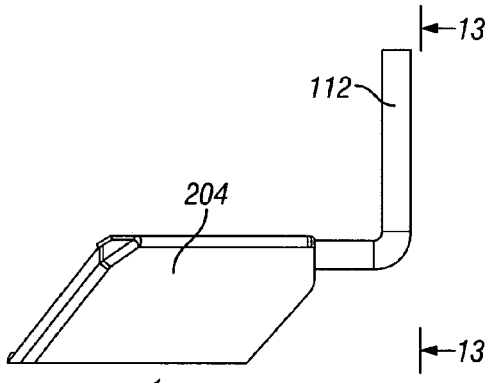
FIG. 12 is a partial side elevation view of the club shown in FIG. 11 and taken generally along 11-11.
Figure 13:
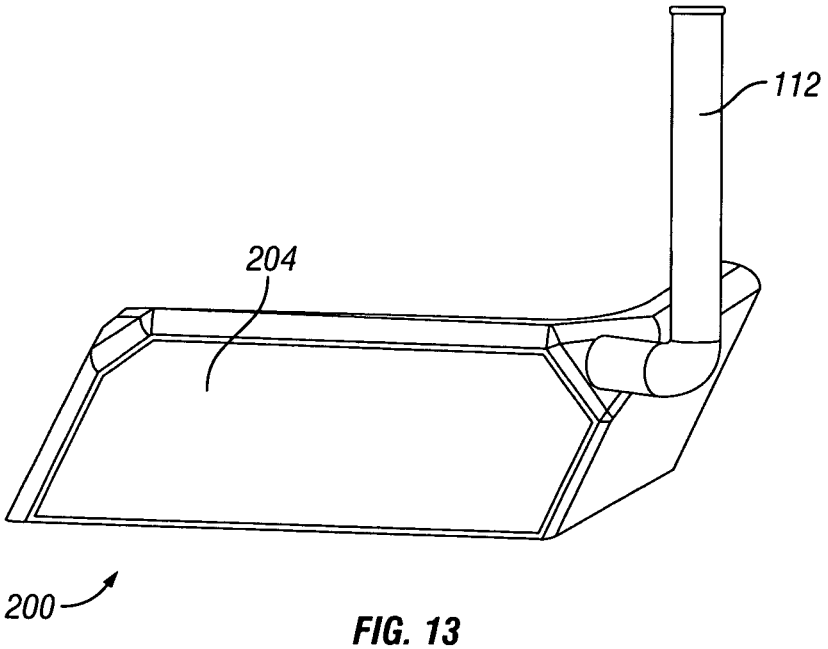
FIG. 13 is a partial elevated rear perspective view of the golf club shown in FIG. 12 and taken generally along 12-12.

Referring to FIGS. 9-12, in the specific embodiment illustrated golf club 200 includes club head which is an iron club head 204 having a central loft angle 146 in the range from about fourteen (14) degrees to about sixty-five (65) degrees. FIG. 9 is a partial elevated front perspective view of golf club 200 according to an embodiment, having iron club head 204. FIG. 10 is a partial top plan view of the golf club 200 shown in FIG. 9 and taken generally along 9-9, having iron club head 204. FIG. 11 is a partial front elevation view of the golf club 200 shown in FIG. 10 and taken generally along 10-10, having iron club head 204. FIG. 12 is a partial side elevation view of the golf club 200 shown in FIG. 11 and taken generally along 11-11, having iron club head 204. FIG. 13 is a partial elevated rear perspective view of the golf club 200 shown in FIG. 12 and taken generally along 12-12, having iron club head 204.

Figure 14:
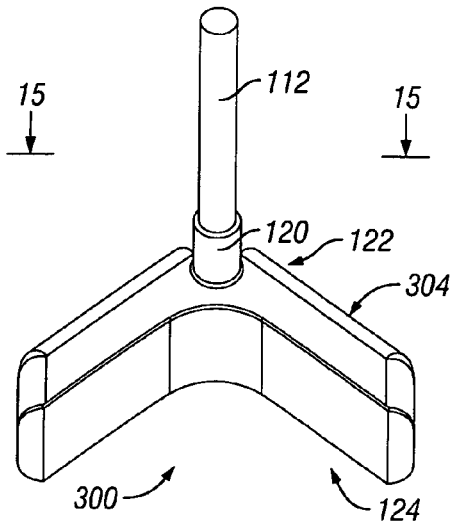
FIG. 14 is a partial elevated front perspective view of a golf club according to an embodiment.
Figure 15:
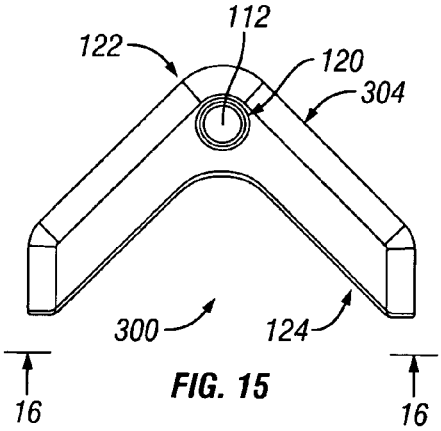
FIG. 15 is a partial top plan view of the golf club shown in FIG. 14 and taken generally along 14-14.
Figure 16:
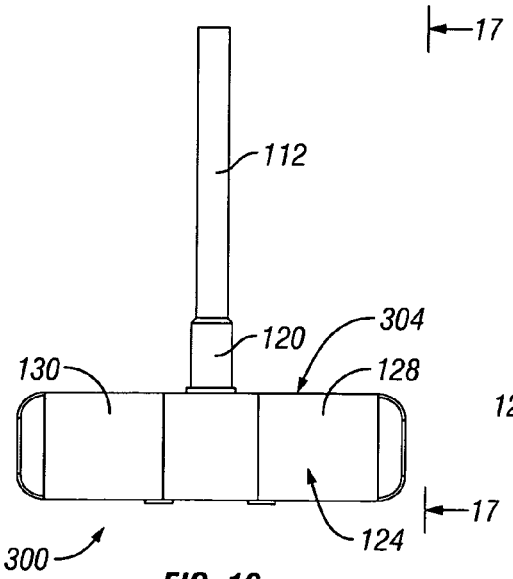
FIG. 16 is a partial front elevation view of the club shown in FIG. 15 and taken generally along 15-15.
Figure 17:
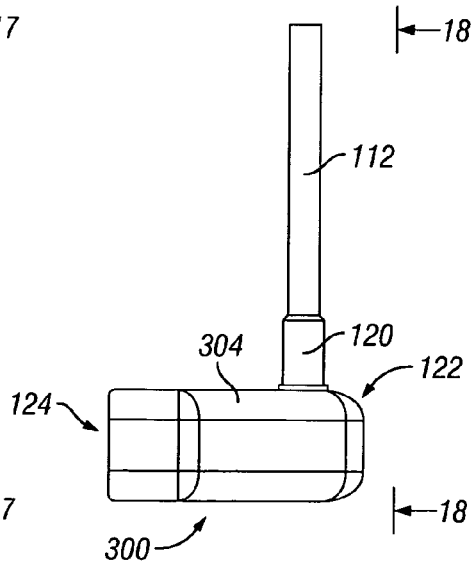
FIG. 17 is a partial side elevation view of the club shown in FIG. 16 and taken generally along 16-16.
Figure 18:
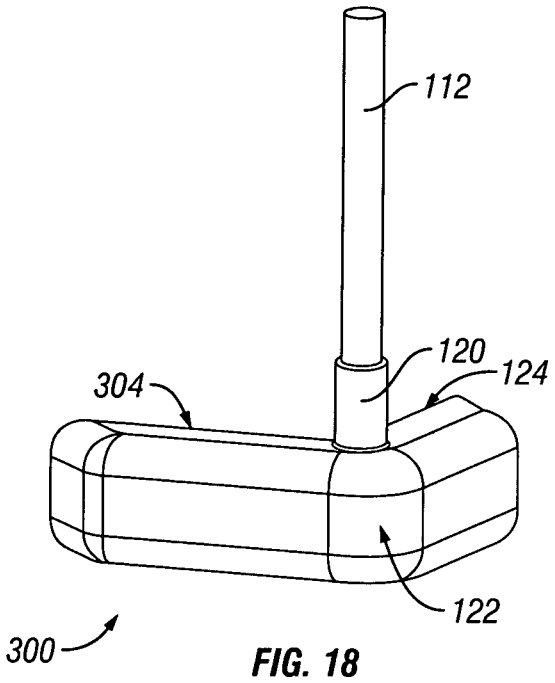
FIG. 18 is a partial elevated rear perspective view of the golf club shown in FIG. 17 and taken generally along 17-17.

Referring to FIGS. 14-18, in the specific embodiment illustrated golf club 300 includes putter club head 304, the central loft angle 146 is in the range from about zero degrees (0°) to about four degrees (4°). FIG. 14 is a partial elevated front perspective view of golf club 300 according to an embodiment, having putter club head 304. FIG. 15 is a partial top plan view of the golf club 300 shown in FIG. 14 and taken generally along 14-14, having putter club head 304. FIG. 16 is a partial front elevation view of the golf club 300 shown in FIG. 15 and taken generally along 15-15, having putter club head 304. FIG. 17 is a partial side elevation view of the golf club 300 shown in FIG. 16 and taken generally along 16-16, having putter club head 304. FIG. 18 is a partial elevated rear perspective view of the golf club 2300 shown in FIG. 17 and taken generally along 17-17, having iron club head 304.

Figure 21:
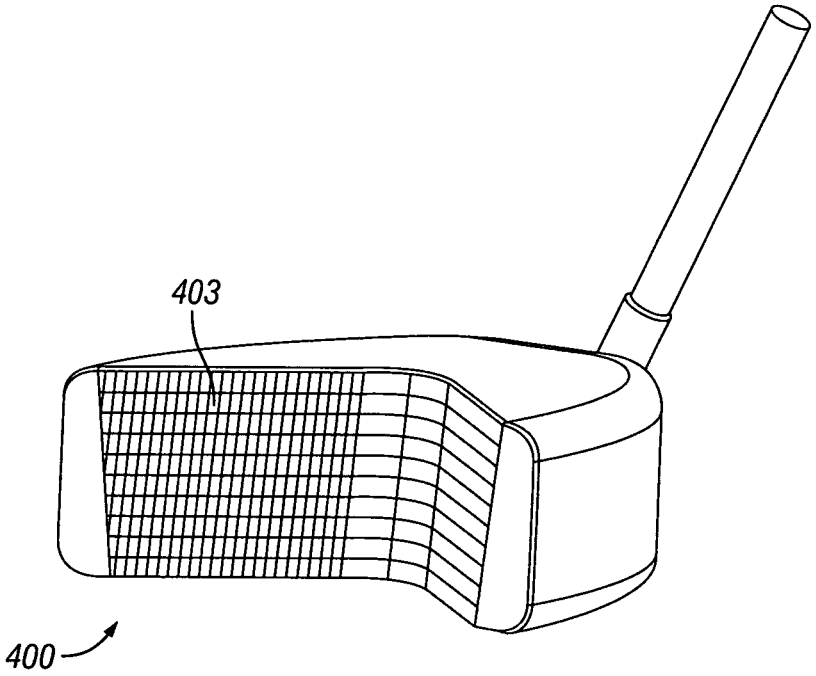
FIG. 21 a partial elevated front perspective view of golf club 400 according to an embodiment.

FIG. 21 a partial elevated front perspective view of golf club 400 according to an embodiment. Golf club 400 is identical to golf club 100 shown in FIGS. 1-6 except as otherwise described and illustrated. Golf club 400 at second club face portion 130 includes spin imparting structure 403. Spin imparting structure 403 is a surface treatment that imparts sidespin to the golf ball 101. In the specific embodiment shown in FIG. 20, spin imparting structure 403 is a set of corrugations machined into the material forming second club face portion 130. One of ordinary skill will understand that any suitable spin imparting structure can be used, such as, for example, surface roughening. One of ordinary skill will understand that spin imparting structure 403 on second club face portion 130 produces a curved trajectory of golf ball 100. More particularly, impact of the golf ball initially by the spin imparting structure 403 on second club face portion 130 causes counterclockwise side spin of the ball as viewed from overhead and causes a trajectory that curves to the left. One of ordinary skill will understand that other embodiments (not shown) can include spin imparting structure 403 on the first club face portion 128 to cause clockwise side spin of the golf ball 100 upon impact and cause a trajectory that curves to the right. One of skill will understand that according to an embodiment (not shown) both first and second club face portions 128, 130 can include spin imparting structure 403. One of ordinary skill will understand that spin imparting structure 403 on the first and second club face portions 128, 130 can be different from each other to impart a curving trajectory that compensates for draw or fade swing tendencies of a particular player 103 with the golf club 400.

Although specific embodiments are illustrated and described herein, it will be appreciated by those of ordinary skill in the art that any arrangement which is calculated to achieve the same purpose can be substituted for the specific embodiments shown. This application is intended to cover any adaptations or variations. For example, although described in terms of the specific embodiments, one of ordinary skill in the art will appreciate that implementations can be made in different embodiments to provide the required function. In particular, one of skill in the art will appreciate that the names and terminology of the apparatus are not intended to limit embodiments. Furthermore, additional apparatus and method steps can be added to the components, functions can be rearranged among the components and method steps, and new components to correspond to future enhancements and physical devices used in embodiments can be introduced without departing from the scope of embodiments. The terminology used in this application is intended to include all environments and alternatives which provide the same functionality as described herein.

What is claimed is:

1. A golf club for striking a golf ball having a diameter of 1.68 inches, the golf club comprising:

an elongated shaft, the shaft having an upper end portion spaced apart from a lower end portion; and a club head disposed at the lower end portion, the club head having a first club-face portion including a loft angle for striking the golf ball, the club head having a second club-face portion including a loft angle for striking the golf ball, the club head having a transition club-face portion with a curved profile for striking the golf ball, the transition club-face portion extending from a first transition with the first club-face portion to a second transition with the second club-face portion, the transition club-face portion having a radius of curvature equal to the radius of the golf ball and a central loft angle, the central loft angle being different than the loft angle of the first and second club-face portions, relative to the first club-face portion the second club-face portion defining there between a ninety degree angle.

2. A golf club according to claim 1 and further comprising:

the first club-face portion defining a first club-face plane, the second club-face portion defining a second club-face plane, the first club-face plane intersecting the second club-face plane along a central loft reference axis, along the central loft reference axis the first club-face plane being disposed at a ninety degree angle relative to the second club-face plane, relative to a zero-loft reference axis the central loft reference axis defining a central loft angle, relative to a horizontal reference plane the zero-loft reference axis defining there between a ninety degree angle.

3. A golf club according to claim 2 and further comprising:

the central loft angle being about zero;

the club head being configured in a putter shape.

4. A golf club according to claim 2 and further comprising:

the central loft angle being in the range from about 7 degrees to about 31 degrees;

the club head being configured in a driving wood shape.

5. A golf club according to claim 2 and further comprising:

the central loft angle being in the range from about 14 degrees to about 65 degrees; the club head being configured in an iron shape.

6. A golf club according to claim 5 and further comprising:

the central loft angle being in the range from about 14 degrees to about 37 degrees.

7. A golf club according to claim 2 and further comprising:

the transition club-face portion having a transition loft angle equal to the central loft angle.

8. A golf club according to claim 7 and further comprising:

the transition club-face portion having a curved profile from a first transition with the first club-face portion to a second transition with the second club-face portion, along the curved profile from the first transition to the second transition the transition club-face portion having a transition loft angle equal to the central loft angle.

9. A golf club according to claim 1 and further comprising:

the transition club-face portion being joined in fixed integral relationship with the first club-face portion, the transition club-face portion being joined in fixed integral relationship with the second club-face portion.

10. A golf club according to claim 1 and further comprising:

the club head being selectively positionable relative to the shaft in a right-handed swing configuration, the club head in the right-handed swing configuration enabling a righthanded person to perform a corresponding right-handed golf swing, the club head being selectively positionable relative to the shaft in a left-handed swing configuration, the club head in the left-handed swing configuration enabling a left-handed person to perform a corresponding left-handed golf swing.

11. A golf club for striking a golf ball having a diameter of 1.68 inches, the golf club comprising:

an elongated shaft, the shaft having an upper end portion spaced apart from a lower end portion;

a club head disposed at the lower end portion;

the club head having a first club-face portion for striking the golf ball, the first club-face portion defining a first club-face plane having a first tilt angle;

the club head having a second club-face portion for striking the golf ball, the second club-face portion defining a second club-face plane having a second tilt angle equal to said first tilt angle, the sum of said first and second tilt angles providing a nominal loft of the golf club;

the club head having a transition club-face portion for striking the golf ball, the transition club-face portion extending from the first club-face portion to the second club-face portion and having a radius of curvature equal to the radius of the golf ball;

the first club-face plane intersecting the second club-face plane along a central loft reference axis; along the central loft reference axis the first club-face plane being disposed at a ninety degree angle relative to the second club-face plane; relative to a zero-loft reference axis the central loft reference axis defining there between a central loft angle greater than said nominal loft; and relative to a horizontal reference plane the zero-loft reference axis defining there between a ninety degree angle.

12. A golf club according to claim 11 and further comprising:

the central loft angle being in the range from about 7 degrees to about 31 degrees;

the club head being configured in a driving wood shape.

13. A golf club according to claim 11 and further comprising:

the central loft angle being in the range from about 14 degrees to about 65 degrees;

the club head being configured in an iron shape.

14. A golf club according to claim 13 and further comprising:

the central loft angle being in the range from about 14 degrees to about 37 degrees.

15. A golf club according to claim 11 and further comprising:

the transition club-face portion extending from a first transition with the first club-face portion to a second transition with the second club-face portion.

16. A golf club according to claim 11 and further comprising:

the transition club-face portion being joined in fixed integral relationship with the first club-face portion, the transition club-face portion being joined in fixed integral relationship with the second club-face portion.

17. A golf club according to claim 11 and further comprising:

the transition club-face portion having a transition loft angle equal to the central loft angle.

18. A golf club according to claim 17 and further comprising:

the transition club-face portion having a curved profile from a first transition with the first club-face portion to a second transition with the second club-face portion, along the curved profile from the first transition to the second transition the transition club-face portion having a transition loft angle equal to the central loft angle.

19. A golf club according to claim 11 and further comprising:

the club head being selectively positionable relative to the shaft in a right-handed swing configuration, the club head in the right-handed swing configuration enabling a righthanded person to perform a corresponding right-handed golf swing, the club head being selectively positionable relative to the shaft in a left-handed swing configuration, the club head in the left-handed swing configuration enabling a left-handed person to perform a corresponding left-handed golf swing.

20. A golf club for striking a golf ball having a diameter of 1.68 inches, the golf club comprising:

an elongated shaft, the shaft having an upper end portion spaced apart from a lower end portion;

a club head disposed at the lower end portion;

the club head having a first club-face portion defined by a loft angle for striking the golf ball, the first club-face portion defining a first club-face plane;

the club head having a second club-face portion defined by a loft angle for striking the golf ball, the second club-face portion defining a second club-face plane;

the first club-face plane intersecting the second club-face plane along a central loft reference axis; along the central loft reference axis the first club-face plane being disposed at a ninety degree angle relative to the second club-face plane; relative to a zero-loft reference axis the central loft reference axis defining there between a central loft angle different from the loft angles of the first and second club-face portions;

relative to a horizontal reference plane the zero-loft reference axis defining there between a ninety degree angle;

the club head having a transition club-face portion for striking the golf ball, the transition club-face portion having a curved profile from a first transition with the first club-face portion to a second transition with the second club-face portion defined by a radius of curvature equal to the radius of the golf ball; and along the curved profile from the first transition to the second transition the transition club-face portion having a transition loft angle equal to the central loft angle.

21. A golf club according to claim 20 and further comprising:

the club head being selectively positionable relative to the shaft in a right-handed swing configuration, the club head in the right-handed swing configuration enabling a right-handed person to perform a corresponding right-handed golf swing, the club head being selectively positionable relative to the shaft in a left-handed swing configuration, the club head in the left-handed swing configuration enabling a left-handed person to perform a corresponding left-handed golf swing.

22. A club head for attachment to a shaft to construct a golf club for striking a golf ball having a first radius, the club head comprising:

a first club-face portion inclined at a first tilt angle for striking the golf ball, the first club-face portion defining a first club-face plane;

a second club-face portion inclined at a second tilt angle for striking the golf ball, the second club-face portion defining a second club-face plane;

a transition club-face portion for striking the golf ball, the transition club-face portion extending from the first club-face portion to the second club-face portion, the transition club-face portion having a curved profile;

the first club-face plane intersecting the second club-face plane along a central loft reference axis; along the central loft reference axis the first club-face plane being disposed at a ninety degree angle relative to the second club-face plane; relative to a zero-loft reference axis the central loft reference axis defining there between a central loft angle; and relative to a horizontal reference plane the zero-loft reference axis defining there between a ninety degree angle;

wherein the central loft angle is related to the first and second tilt angles according to the equation:

$$(\text{central loft angle})=\tan^{-1}[(\sqrt{2})\times\tan(\text{first or second tilt angle})].$$

23. A club head according to claim 22 and further comprising:

the transition club-face portion having a curved profile from a first transition with the first club-face portion to a second transition with the second club-face portion, along the curved profile from the first transition to the second transition the transition club-face portion having a transition loft angle equal to the central loft angle, the transition club-face portion having a radius of curvature equal to the first radius.

24. A club head according to claim 22 and further comprising: the central loft angle being about zero; the club head being configured in a putter shape.

25. A club head according to claim 22 and further comprising:

the central loft angle being in the range from about 7 degrees to about 31 degrees;

the club head being configured in a driving wood shape.

26. A club head according to claim 22 and further comprising:

the central loft angle being in the range from about 14 degrees to about 65 degrees;

the club head being configured in an iron shape.

27. A club head according to claim 26 and further comprising:

the central loft angle being in the range from about 14 degrees to about 37 degrees.

* * * * *